US007398626B2

(12) United States Patent
Greschbach

(10) Patent No.: US 7,398,626 B2
(45) Date of Patent: Jul. 15, 2008

(54) MODULE FOR BUILDING PLATFORMS

(76) Inventor: Hubertus Greschbach, Wiesenstrasse 11a, 79341 Kenzingen (DE)

( * ) Notice: Subject to any disclaimer, the term of this patent is extended or adjusted under 35 U.S.C. 154(b) by 0 days.

(21) Appl. No.: 10/312,595

(22) PCT Filed: Jul. 23, 2001

(86) PCT No.: PCT/EP01/08490

§ 371 (c)(1),
(2), (4) Date: Jun. 19, 2003

(87) PCT Pub. No.: WO02/08546

PCT Pub. Date: Jan. 31, 2002

(65) Prior Publication Data

US 2004/0020154 A1 Feb. 5, 2004

(30) Foreign Application Priority Data

Jul. 22, 2000 (DE) ..... 100 36 021

(51) Int. Cl.
*E04H 12/00* (2006.01)

(52) U.S. Cl. ..... 52/650.3; 52/7; 52/36.1; 52/180; 52/582.2; 52/656.9; 403/321

(58) Field of Classification Search ..... 52/582.1, 52/7, 29, 127.9, 582.2, 585, 593, 36.1, 180, 52/650.3, 660, 415, 665.1, 656.9, 585.1, 52/665; 403/321, 322.1, 322.4, 323, 324, 403/330

See application file for complete search history.

(56) References Cited

U.S. PATENT DOCUMENTS

| | | | | | |
|---|---|---|---|---|---|
| 917,859 | A | * | 4/1909 | Fusch | 52/489.1 |
| 1,946,035 | A | * | 2/1934 | Reuter | 52/180 |
| 3,181,203 | A | * | 5/1965 | Wenger | 52/6 |
| 3,777,434 | A | * | 12/1973 | Selden et al. | 52/28 |
| 3,900,179 | A | * | 8/1975 | Mocny et al. | 248/287.1 |
| 4,250,834 | A | * | 2/1981 | Cheselka | 119/169 |
| 4,436,779 | A | * | 3/1984 | Menconi et al. | 428/169 |
| 5,323,564 | A | | 6/1994 | Mensching et al. | |
| 6,047,663 | A | * | 4/2000 | Moreau et al. | 119/529 |
| 6,050,033 | A | * | 4/2000 | Wrightman | 52/93.1 |
| 6,061,979 | A | * | 5/2000 | Johannes | 52/177 |
| 6,106,186 | A | * | 8/2000 | Taipale et al. | 403/322.4 |
| 6,148,834 | A | * | 11/2000 | Grooms, Sr. | 135/116 |
| 6,772,564 | B2 | * | 8/2004 | Leon | 52/126.5 |

FOREIGN PATENT DOCUMENTS

| | | |
|---|---|---|
| DE | 91 02 477 U | 5/1991 |
| DE | 41 35 662 C1 | 12/1992 |
| FR | 2 532 977 A1 | 9/1982 |
| FR | 2 585 752 A1 | 2/1987 |
| FR | 2 679 585 A1 | 1/1993 |

* cited by examiner

*Primary Examiner*—Daniel P. Stodola
*Assistant Examiner*—Nahid Amiri
(74) *Attorney, Agent, or Firm*—Shlesinger, Arkwright & Garvy LLP

(57) ABSTRACT

The invention relates to a module for building platforms, stages, or flooring, which is particularly suitable for use outside. The module comprises a ladder-type frame, supporting devices, connecting means and, preferably, covering elements.

15 Claims, 13 Drawing Sheets

MODULE FOR BUILDING PLATFORMS

The invention relates to a module for constructing platforms, walls, roofs, stages or floors and is particularly suitable for use in the open air.

All kinds of organisations such as cultural, scientific and sporting exhibitions or the presentation of new products often require stable, safe floors or platforms on which the various equipment such as stages, wings, exhibition stands, podiums or seating can be set up. Frequently, such events take place in the open air and their duration is often restricted to a few hours or days. The erecting of a substructure with conventional means such as grid frames or elements known from scaffolding is highly labour-intensive. When the surface being built on is very uneven, the proportion of expenditure allocated to the substructure may be up to 60%. In particular, the levelling of the flooring being laid is problematic and is a time-consuming and costly factor.

A reusable stage segment which is used to construct level stage surfaces is known from U.S. Pat. No. 5,323,564. For this, stage segments arranged side by side are joined together. The stage segment described has a baseelement made up of a plurality of longitudinal and transverse bearers and having a decking surface. Moreover, connecting means are provided for connecting the stage segments and support means for low-friction abutment of the stage segments.

From the specification G 91 02 477.3 U1, a platform segment is known which comprises a frame having a grid pattern supporting a decking layer. In addition, vertically adjustable feet and assembly elements which can be folded into the frame for connecting platform segments located side by side in the grid are provided. The platform segment is used for constructing raised platforms, in which only platform segments arranged side by side can be joined together.

A disadvantage of these apparatus described in the prior art is that they can only be used to assemble level stages and moreover their stability and the stability of the arrangement as a whole is only guaranteed by the decking layers supported by the frame.

By contrast the module according to the invention for constructing platforms, stages, walls or floors comprises a ladder-type frame which is made up of a plurality of longitudinal and transverse bearers as the load-bearing structure. The module according to the invention has associated support means. In addition, connecting means are provided which are disposed at attachment points on the ladder-type frame and are designed for interlocking and frictional engagement of modules with one another, the geometry of the attachment points being such that it is possible for modules to dock with one another in all spatial directions.

The platform module according to the invention thus comprises a ladder-type frame, support means and connecting means. The ladder-type frame is made up of a plurality of longitudinal and transverse bearers which are preferably arranged perpendicular to one another. The ladder-type frame constitutes the load-bearing structure of the module. Covering elements may be mounted on the top of it to form the surface of the module. A construction of this kind results in high stability and load-bearing capacity while at the same time having a low inherent weight.

On the ladder-type frame, connecting means are provided which allow fast and secure connection and disconnection of platform modules arranged side by side. The connecting means may be provided at the ends and the points of intersection of the longitudinal and transverse bearers. They are preferably constructed in the manner of coupling and plug means but may also be constructed as screw-type and rotary closures. The plug-type connecting means extend substantially in the longitudinal direction of the bearers. As a result the plug-type connecting means may easily be arranged to be moveable along the carrier in the longitudinal direction and capable of being pushed in and pulled out. This makes it possible for the plug-type means to be pulled or pushed out of the module or carrier only when necessary, i.e. for connecting to another module. Consequently, any plug-type connecting means which are not in use do not protrude from the carrier or platform module. The connecting means are thus on the one hand protected from damage, e.g. during transportation or during assembly, and in addition the risk of injury caused by protruding edges is prevented.

Moreover, a construction with extendable connecting means is also advantageous with regard to connecting a number of modules to one another. This prevents the connecting means from defining a preferential direction for the moving together or alignment of the modules with one another, e.g. in the form of a horizontal or vertical movement determined by engagement hooks and eyes. The alignment of the modules with one another is thus not prevented by the connecting means and is consequently made much easier. The modules may first be aligned with one another and then the position of the modules relative to one another may be secured by extending the plug-type connecting means into the coupling-type connecting means.

The connecting means may be provided in the form of screw-type and rotary closures. These are preferably arranged on the tops and bottoms of the module. Preferably 4 attachment points are provided every 9 m5 of area. Using these attachment points other modules may be attached as walls, supports and applications of all kinds. The geometry of the attachment points may be selected so that modules can be docked with one another in every spatial direction and in any position. Thus, all six sides of the module are available as a docking surface.

The module element is associated, preferably at the points of intersection of the ladder-type frame, with support means by which the platform module rests on the ground or substructure. The support means are preferably individually adjustable in height so that the platform module can be aligned in the horizontal direction without any additional means and substantially independently of the nature of the ground underneath. The support means may be constructed so that they can be retracted into the module. This enables platform modules to be stacked in a space-saving manner for transporting or storage. The support means are preferably provided at the points of intersection of the longitudinal and transverse bearers as these regions are characterised by their high load-bearing capacity and the module or platform is thus able to bear high loads per unit area.

Preferably, side walls are provided. These are formed by panels or side elements arranged on the end faces of the longitudinal and transverse bearers and comprising openings for the connecting means. The side faces are constructed so that longitudinal edges along the upper surface of the module form a groove or chamfer with the side face. When two modules are joined together a channel is thus formed in the upper region of adjacent side walls. As a result, a channel system in which supply lines can be laid is created on the surface of the assembled platform along the edges of the modules. The cable channels can quickly and easily be sealed off by means of suitable covers after the lines have been laid, thus maintaining a flat platform surface.

Further advantages and features of the invention will become apparent from the specification and the accompanying drawings.

It will be appreciated that the features mentioned above and those to be described hereinafter may be used not only in the particular combination specified but in other combinations or on their own without departing from the scope of the present invention.

The invention is illustrated in the drawings and explained more fully hereinafter with reference to the drawings.

Figures 2, 2A:
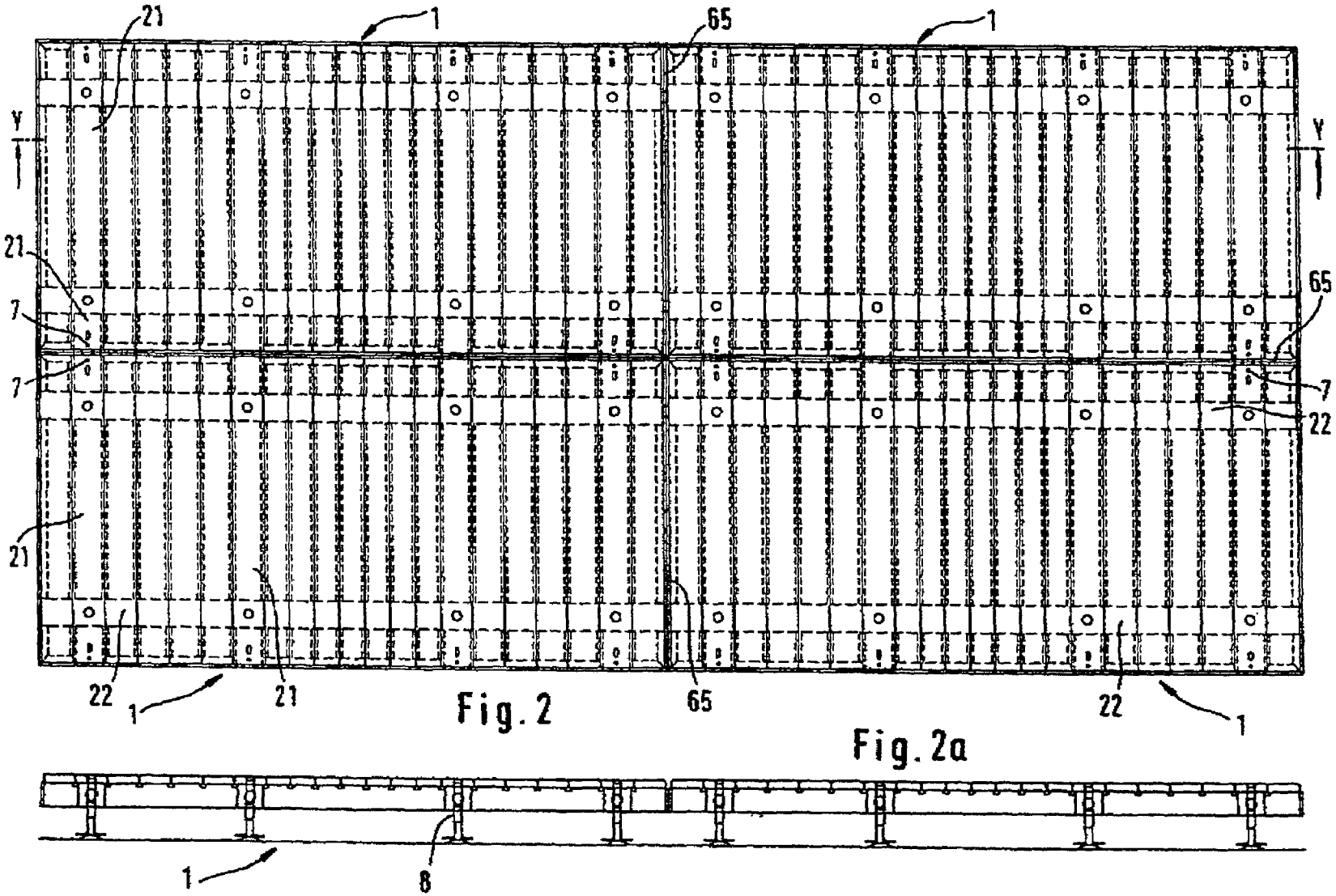
FIG. 2 shows a plan view of four platform modules joined together.
Figure 3:
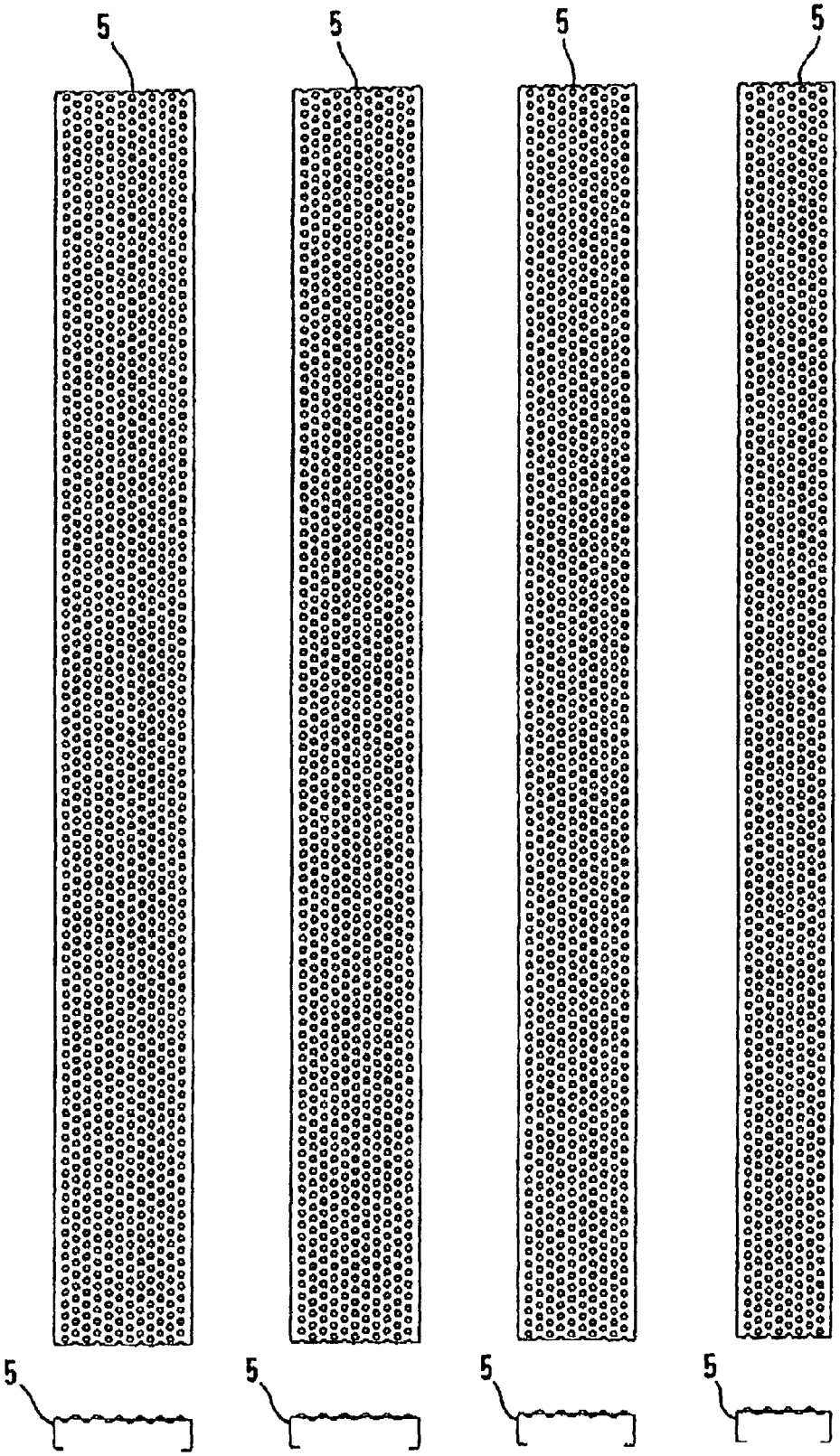
Figures 3A, 3B:
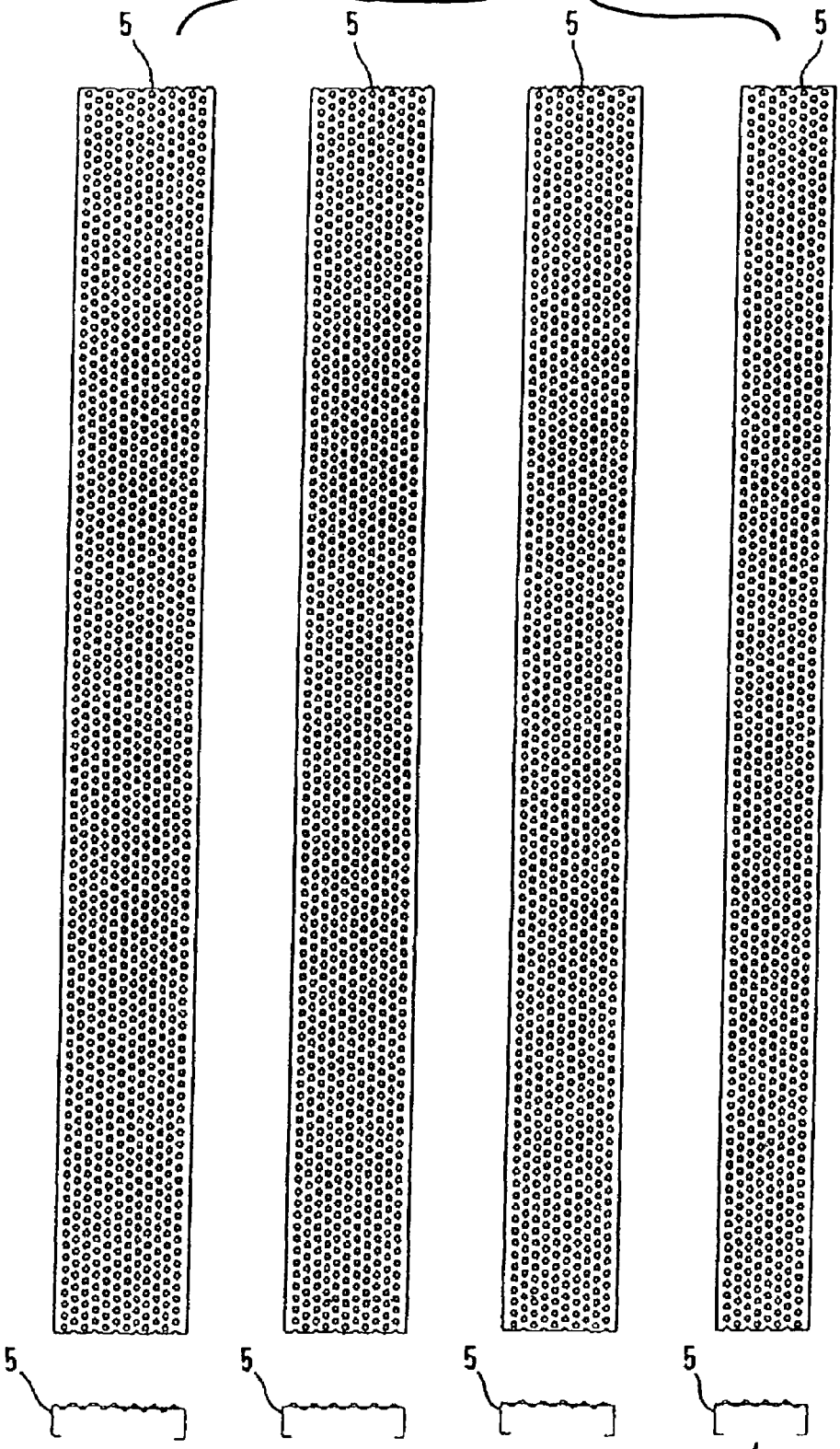
Figure 4:
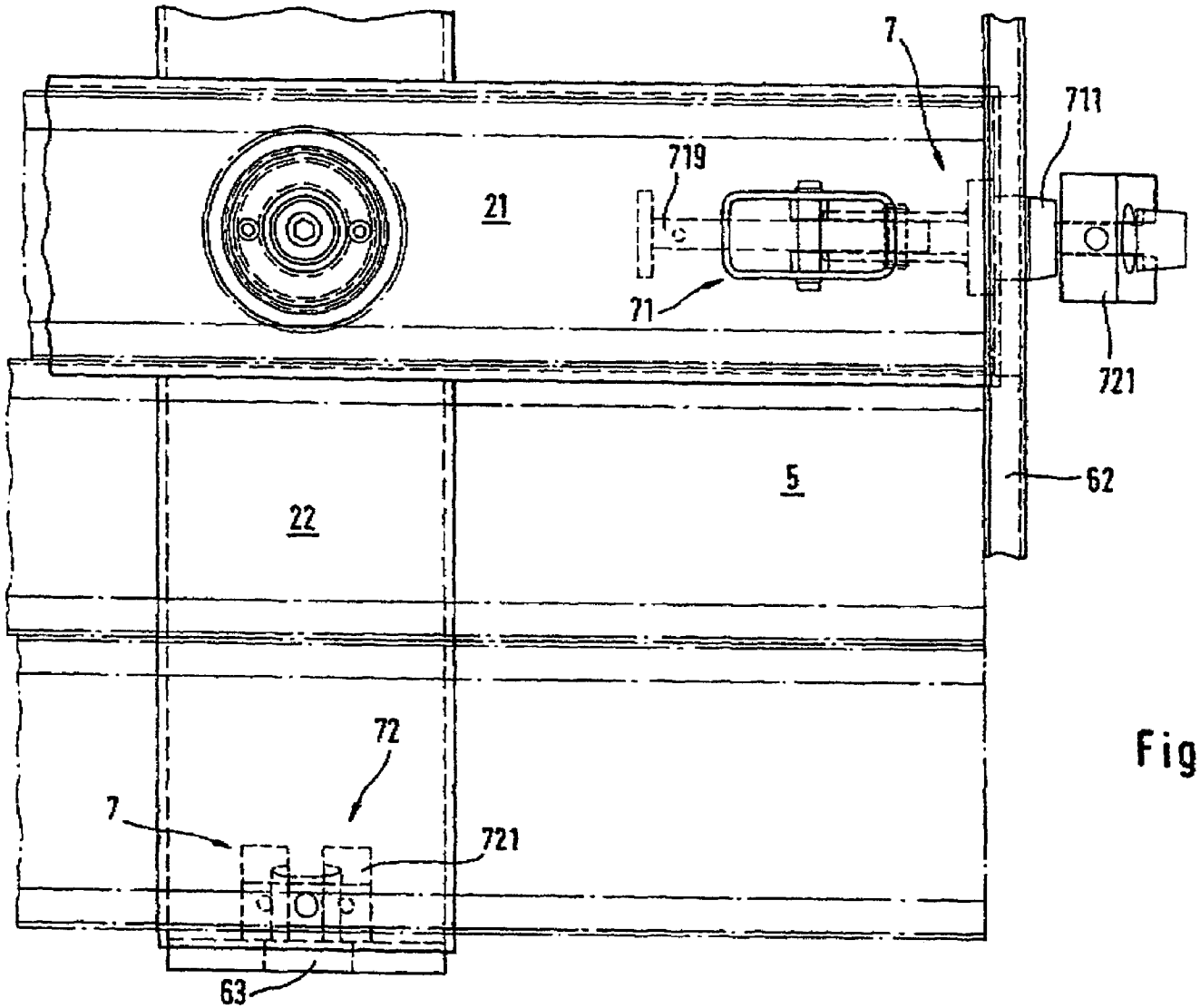
Figure 5:
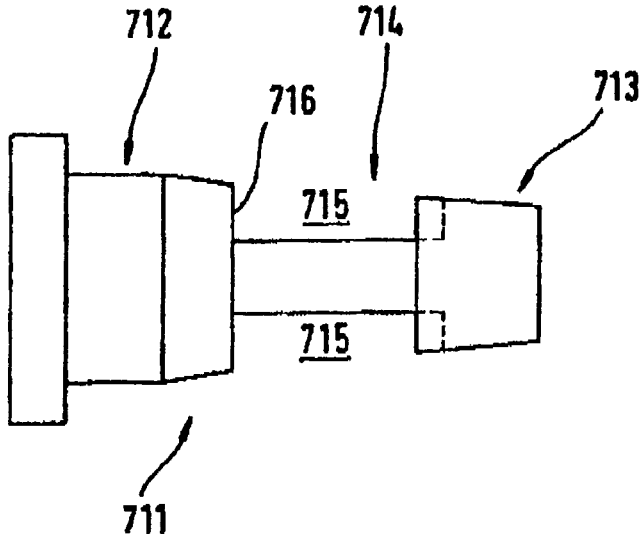
Figure 5:
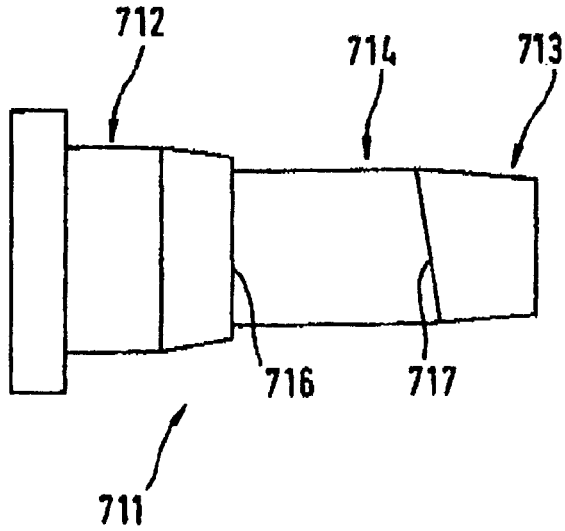
Figure 5:
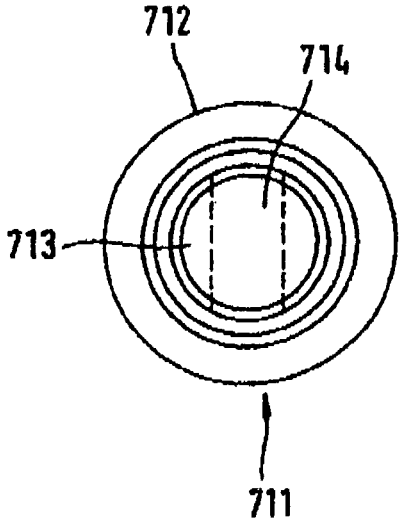
Figure 6:
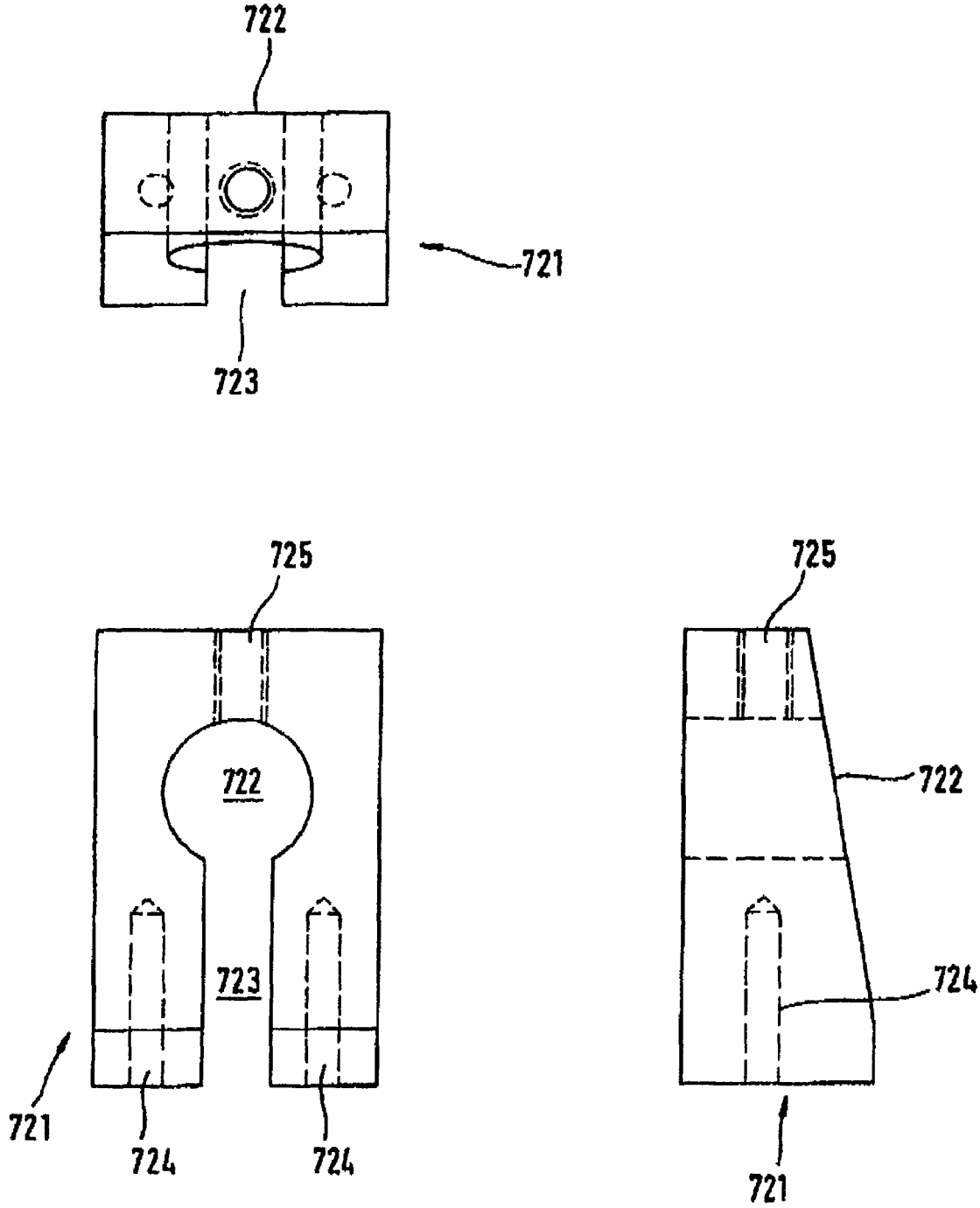
Figure 7:
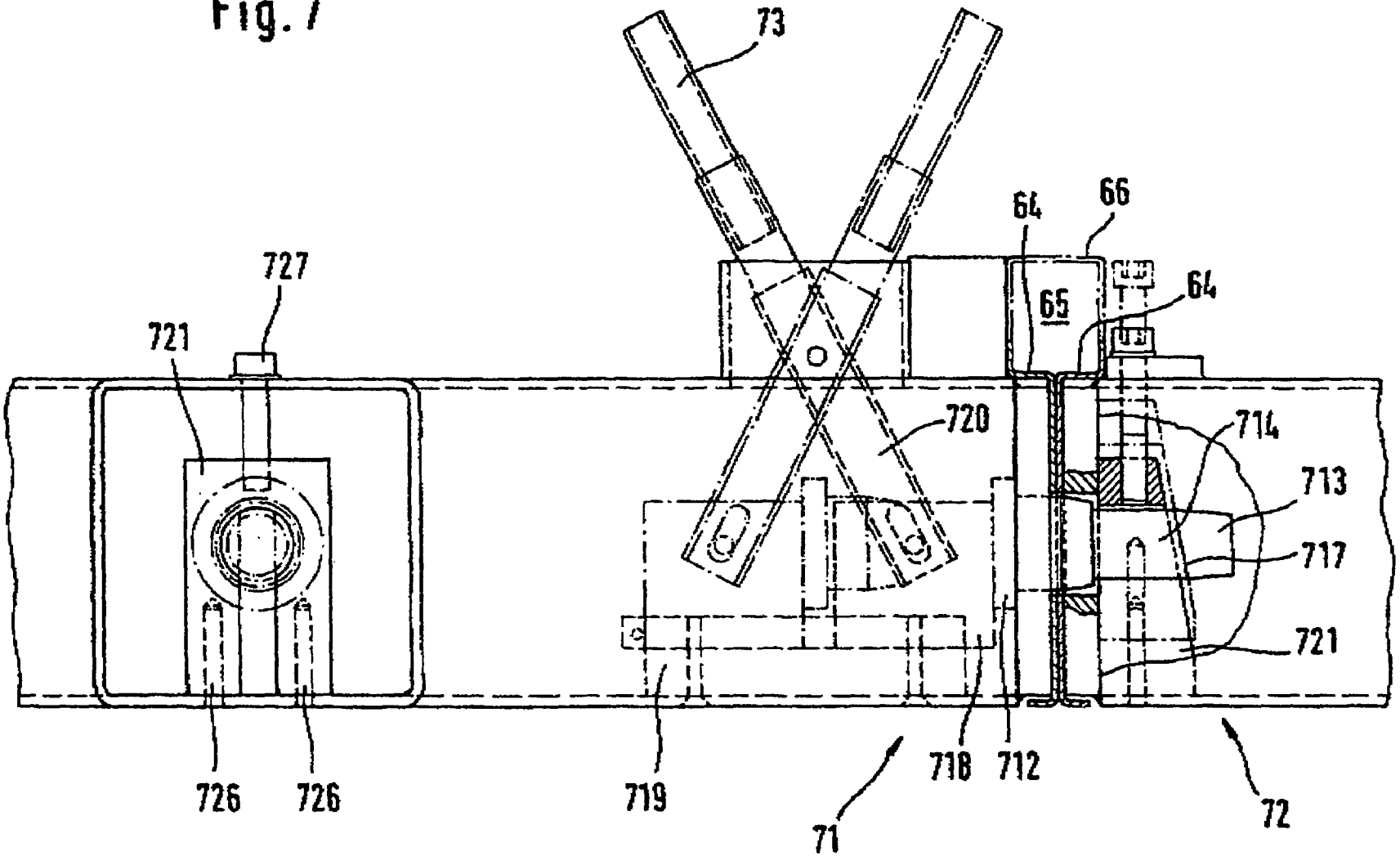
Figure 8:
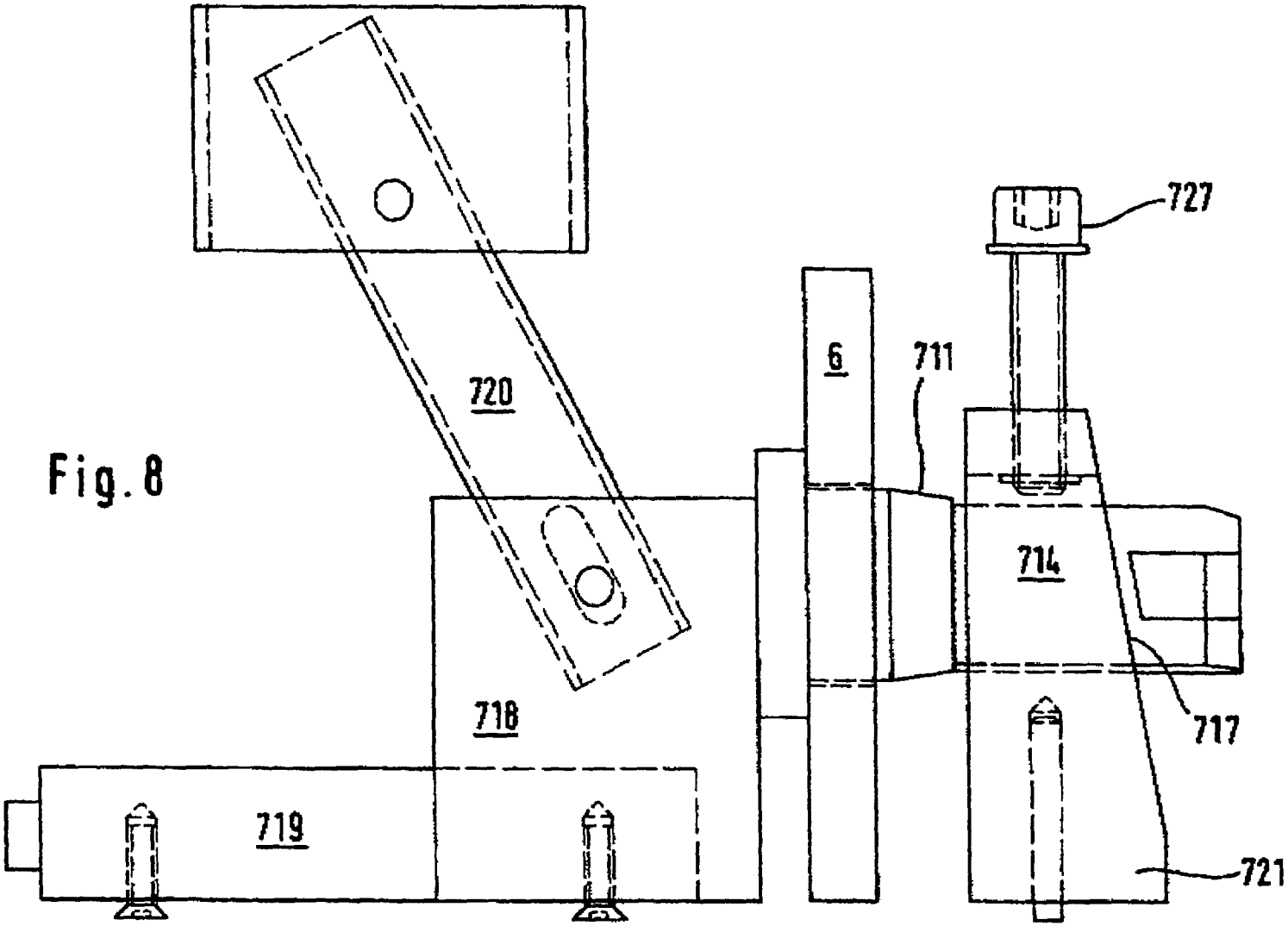
Figure 9:
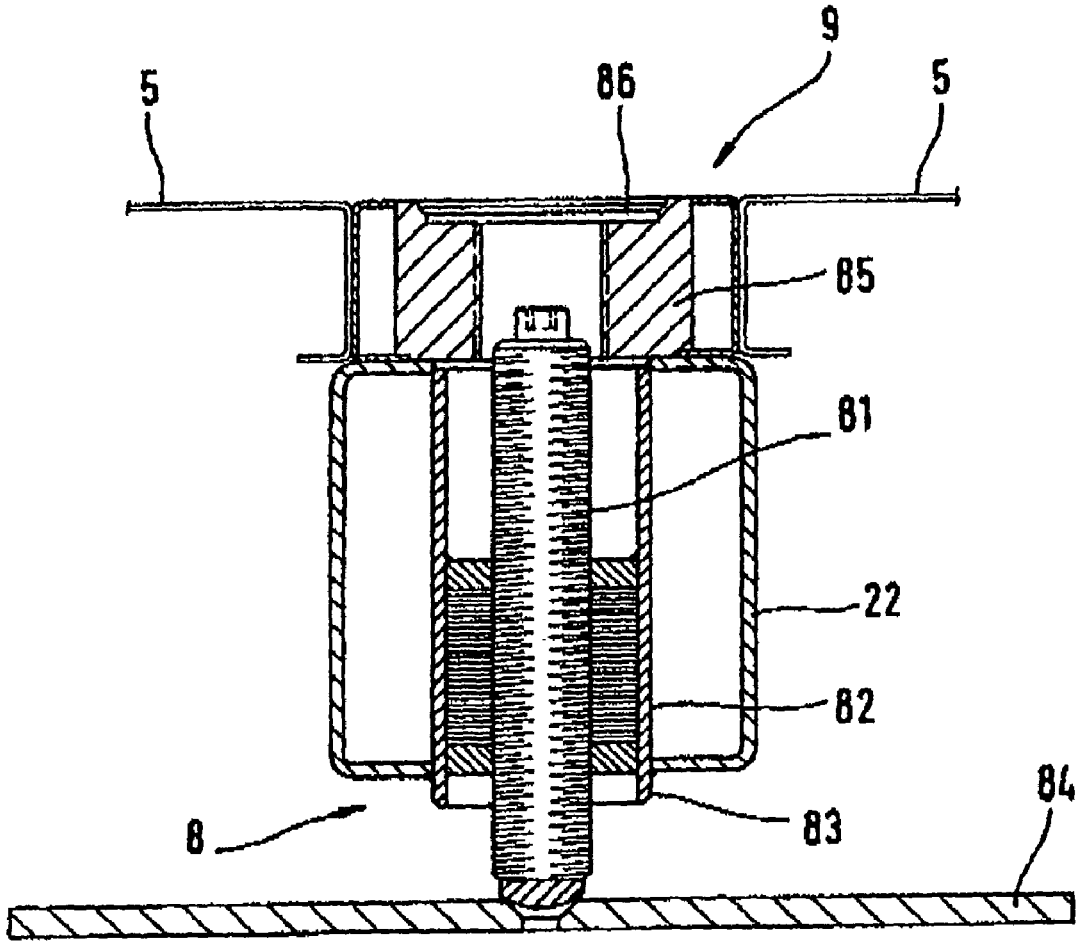
Figure 10:
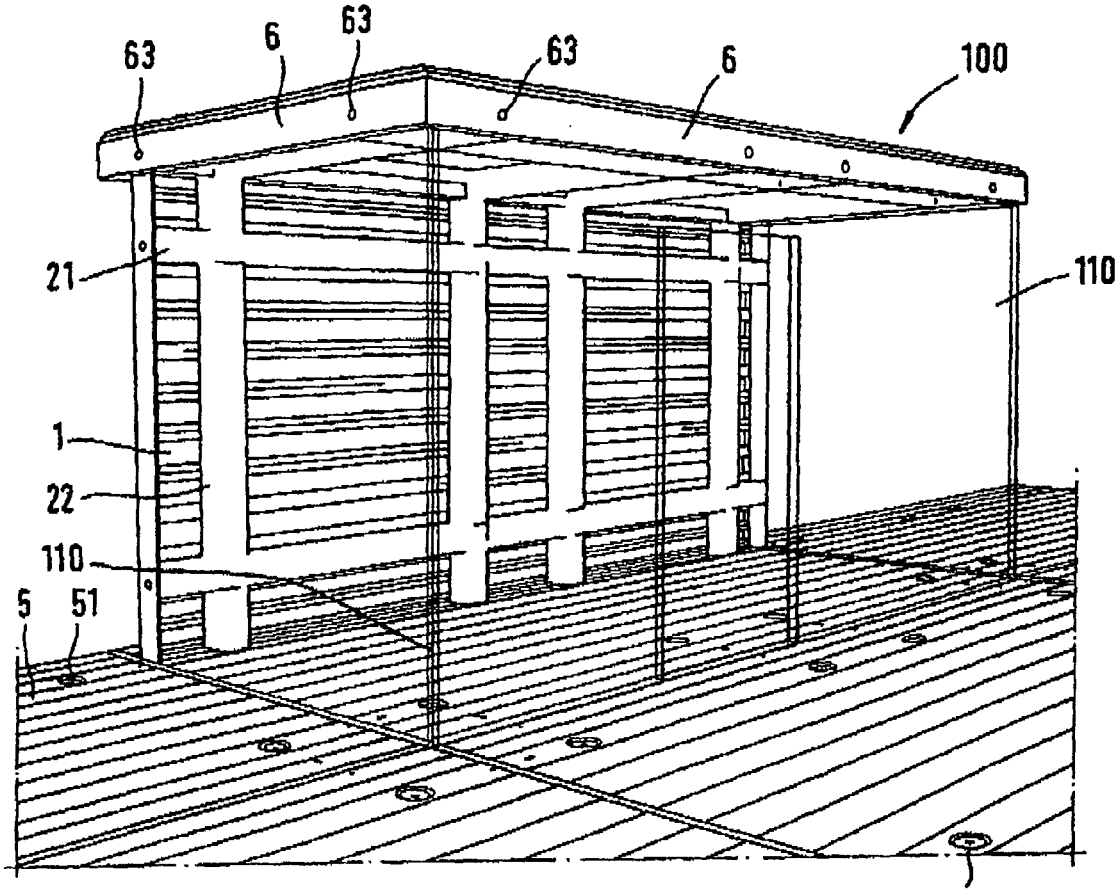
Figure 11:
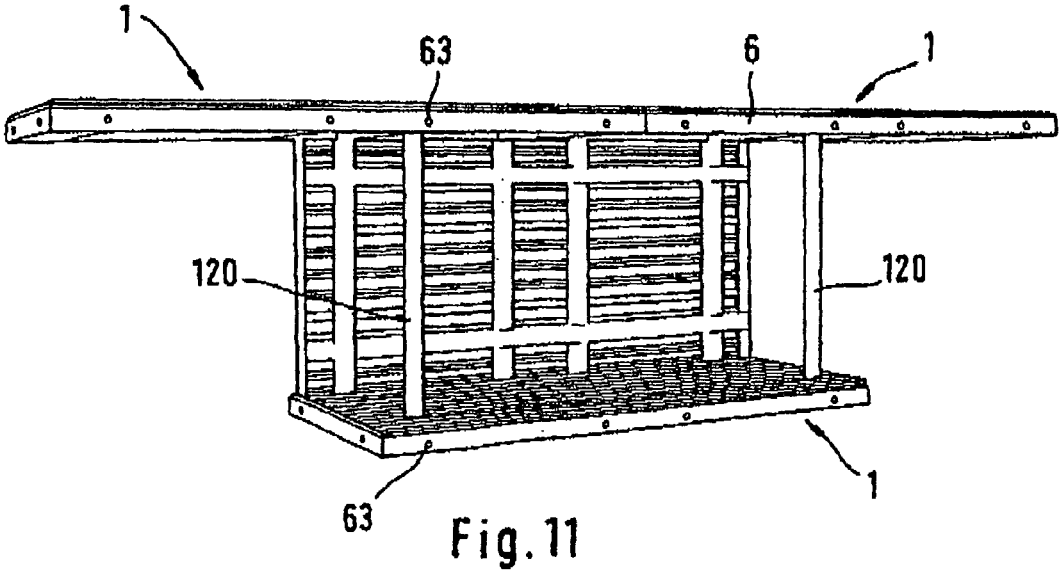
Figure 12:
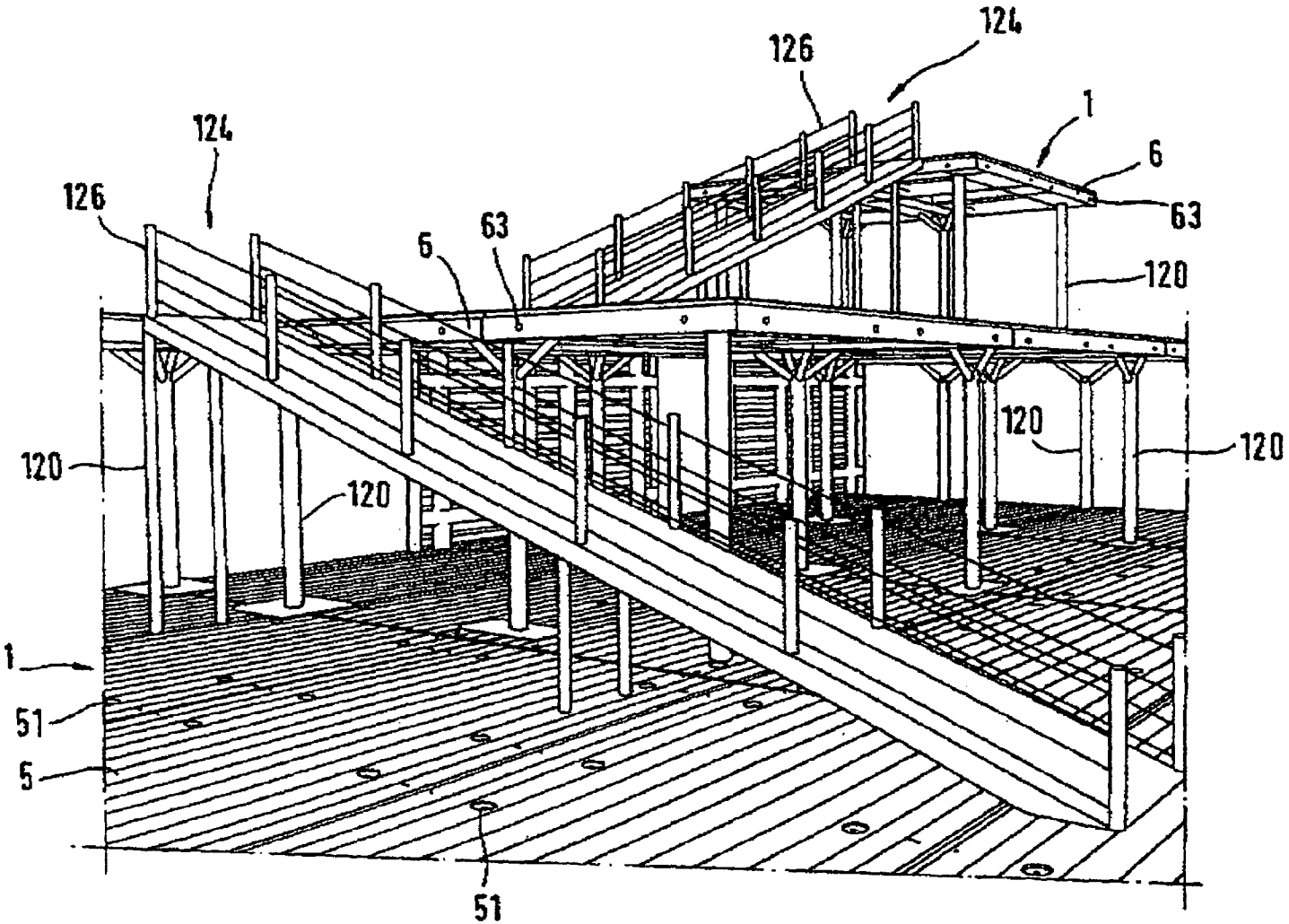
Figure 13:
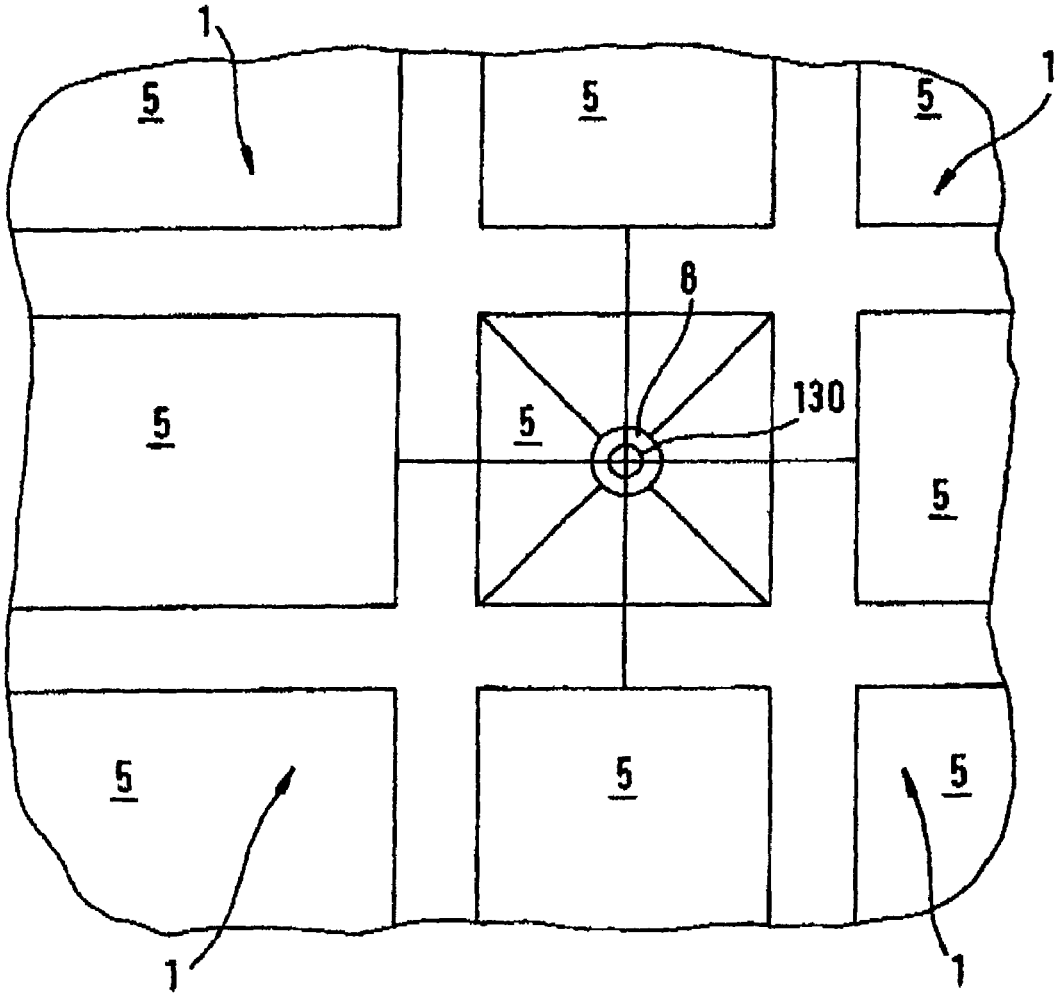

FIG. 2*a* shows a sectional view of FIG. 2 on the line Y-Y,

FIG. 3 shows a number of surface elements in plan view and side elevation,

FIG. 4 shows a plan view of part of the module in the region of a connecting means, FIG. 5 shows three views of a connecting bolt, FIG. 6 shows three views of a locking wedge, FIG. 7 shows a side view on the line X-X in FIG. 4, FIG. 8 shows a diagrammatic view of connecting means at the plug end and coupling end which are in effective engagement and FIG. 9 shows a sectional view of a support device for the platform module according to the invention, FIG. 10 shows a container constructed using the module according to the invention, in perspective view, FIG. 11 shows another use of the module according to the invention in perspective view, FIG. 12 shows a complex application of the module according to the invention in perspective view, FIG. 13 shows four module elements according to the invention with a support device.

Figure 1:
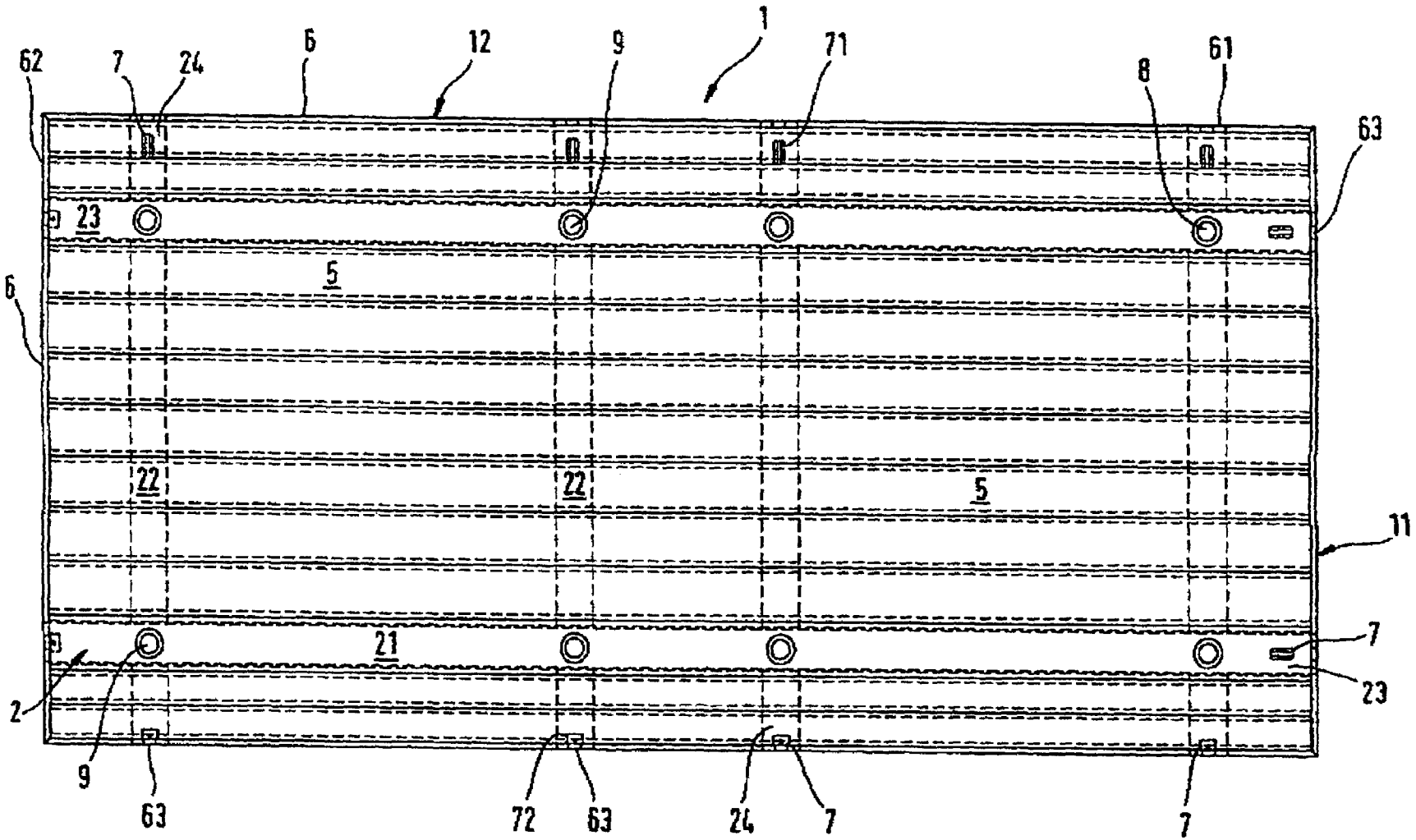
FIG. 1 shows a plan view of a platform module according to the invention.

FIG. 1 is a plan view of a platform module 1 according to the invention which comprises a ladder-type frame 2, surfaces or covering elements 5, side elements 6, connecting means 7 and support means 8.

The ladder-type frame 2 forms the load-bearing base construction of the platform module 1. This is made of steel girder or bearers of square hollow cross-section, for example. In the embodiment shown by way of example, four transverse bearers 21 are welded to two longitudinal bearers 22. Longitudinal bearers 22 and transverse bearers 21 are aligned perpendicular to one another and arranged in a plane in such a way that the points of intersection 9 of the transverse bearers 21 and longitudinal bearers 22 are at a uniform spacing from the corresponding ends 23, 24 of the transverse bearer 21, 22. Support means 8 are provided at the points of intersection 9 of the longitudinal bearers 22 and transverse bearers 21. Connecting means 7 are provided at both ends of the transverse bearers 21 and longitudinal bearers.

The arrangement of the longitudinal and transverse bearers 22, 21 forms a grid pattern for the support means 8 and connecting means 7. The grid pattern is selected so that the spacing along the transverse bearers 21, i.e. along the transverse side 11 of the platform module, is repeated in the grid spacing along the longitudinal bearer 22, i.e. along the longitudinal sides 12 of the platform module 1. This ensures that the platform modules 1 can be joined together not only along their longitudinal sides 11 or transverse sides 12 but also across the longitudinal side 11 and transverse side 12. The shape and size of a platform constructed from modules 1 can thus be made more variable.

The points of intersection 9 of the transverse bearers 21 and longitudinal bearers 22 may be provided as fixing points for the support means 8. For this reason the longitudinal bearers 22 and transverse bearers 21 have openings at the point of intersection 9, on the top and bottom, preferably in the form of through-bores. The support means 8 are secured in the bottom opening while the top opening serves as an access opening for the support means.

The connecting means 7 are provided in the region of the ends 23, 24 of the transverse bearers 21 and longitudinal bearers 22. The connecting means 7 are constructed as a plug and coupling connection and comprise connecting means 71 at the plug end and connecting means 72 at the coupling end. The coupling means 71 at the plug end are provided so as to be moveable into and out of the steel bearers 21, 22. The connecting means 71 at the plug end are thus protected from damage in their retracted position, e.g. during transportation. The connecting means 7 are mounted in the open ends 23, 24 of the steel bearers.

In the embodiment described by way of example, connecting means 71 at the plug end and connecting means 72 at the coupling end are provided along a longitudinal side 11 and transverse side 12 of the platform module. However, it is also possible for coupling-side and plug-side connecting means 71, 72 to be arranged alternately.

Surface element 5 which form the surface of the platform module 1 are fixed to the top of the ladder-type frame 2. Side elements 6 are mounted on the end faces of the transverse bearers 21 and longitudinal bearers 22 and form longitudinal side walls 62 and transverse side walls 61. The module 1 thus has four flat side faces and one flat upper surface, which terminate substantially smoothly with their surroundings.

In the side elements 6 there are openings 63 through which the connecting means 7 can co-operate with connecting means of adjacent platform modules. In order to construct a platform the platform modules 1 are aligned with their longitudinal or transverse sides adjacent one another and are firmly joined together by means of the connecting means 7. By a suitable arrangement of a number of platform modules 1, platform areas can be produced on virtually any scale.

FIG. 2 shows a plan view of a platform by way of example made up of four platform modules 1 joined together. Associated transverse bearers 21 and longitudinal bearers 22 of adjacent platform modules 1 are firmly joined together by means of the connecting means 7, thus forming an extended ladder-type frame of the same size as the platform which is to be constructed.

FIG. 2*a* shows a longitudinal section through the platform along the section line Y-Y. The platform stands on support means 8 of the platform modules 1 in question. In the embodiment shown, each module 1 has eight such support means 8. The load per unit area is transferred to the ground underneath through the support means 8. The support means 8 are constructed to be adjustable in height. As a result, any unevenness of the ground can easily be balanced out by suitably adjusting the width of the support. The platform or the individual modules 1 can thus easily be levelled in height during construction without the need for additional means. Depending on the required load per unit area, it may not be necessary to use all eight support means 8 of a module 1 to support the platform, resulting in faster erection and dismantling.

FIG. 3 shows four individual surface elements 5 of different widths in plan view and side view. A plurality of these elements of suitable width are secured to the ladder-type frame 2 side by side by means of screw or weld joints and then form the surface of the module. Perforated stainless steel caissons are provided as the surface elements 5. The stainless steel caissons 5 have a substantially U-shaped cross-section. The perforation of the caissons 5 on the one hand allows the organisation's equipment to be fixed in this grid of perforations, on the one hand, thus permitting a very flexible configuration of attachments to the platform surface. On the other hand it ensures that no pools of liquid, e.g. rainwater, can collect on the platform surface.

As shown in FIGS. 1 and 2 the surface elements 5 are of such dimensions that the surface formed is smaller than the outer dimensions of the ladder-type frame and is at least partly enclosed by the longitudinal and transverse side walls 61 and 62 of the module 1. FIG. 7 shows this in detail. The longitudinal and transverse side walls 61 and 62 have a shoulder 64 level with the surface elements 5. When two platform modules 1 are joined together a channel 65 is formed in the platform surface between the modules by the abutting shoulders 64. This channel is suitable for laying cables or other supply lines. The channel can be closed off by means of a suitable covering element 66, e.g. a U-shaped profile, so as to form a flat platform surface.

FIG. 4 shows a plan view of a detail in the region of the connecting device 7, namely the plug-side connecting means 71, which is disposed in a longitudinal bearer 4, and the coupling-side connecting means 72 which is disposed in a transverse bearer 3. The plug-side connecting means 71 comprises a connecting bolt 711 arranged so as to be moveable within the longitudinal bearer 4 and cooperating with a locking wedge 721 of the coupling-side connecting means. FIG. 4 shows the connecting bolt 711 in the extended position and operatively connected to the locking wedge 721.

In the interests of clarity and to make it easier to understand, the connecting bolt 711 in FIG. 5 and the locking wedge 721 in FIG. 6 are each shown in three views.

The connecting bolt 711 shown in FIG. 5 has a cylindrically shaped end 712 at the fixing end. In the direction of the plug-side end 713 the connecting bolt 711 is conically tapered. A central region 714 between the plug side end 713 and the fixing-side end 712 is formed in the manner of a panel by two recesses, This region 714 has vertical cheek surfaces 716 in the direction of the end 712 on the fixing side and inclined cheek surfaces 717 in the direction of the end 713 on the plug side.

The locking wedge 721 shown in FIG. 6 is shaped so as to be able to engage by interlocking in the recesses in the central region 714 of the connecting bolt. For this purpose the locking wedge 721 is made into a fork shape by means of a slot 723. The slot 723 extends into a through-bore 722 which is larger in diameter than the width of the slot. The width of the slot 723 corresponds to the width of the disk-shaped central region 714 of the connecting bolt 711. The bore 722 is of such dimensions that the end 713 on the plug side of the connecting bolt 711 can pass through it. Unlike the connecting bolt 711 the locking wedge 721 is moveably disposed in the steel bearer 21, 22 perpendicular to the longitudinal axis and hence also perpendicular to the longitudinal axis of the direction of connection of the connecting means 71, 72 at the plug and coupling ends. Bores 724 and 725 in the top and bottom of the locking wedge act as guides for this movement.

Referring now to FIGS. 7 and 8, a locking process will now be explained. FIG. 7 shows a sectional view along the line X-X in FIG. 4. FIG. 8 is a diagrammatic representation of the connecting means 71, 72 at the plug and coupling ends in operative engagement. The end 712 of the connecting bolt 711 at the fixing end is connected to a slide 718. The slide is mounted to be moveable along a guide rail 719. The slide 718 can be moved with the connecting bolt 711 along the guide rail 719 by means of a pivotably mounted lever 720, the lever 720 being arranged completely below the surface formed by the fixing elements 5. An actuating element 73 can be brought into engagement with the lever 720 through recesses in the surface element 5 and the connecting bolt 711 can be moved in and out by pivoting the actuating element 73, FIG. 7 shows the two end positions of the lever 720 and actuating element 73 with the connecting bolt 711 pushed in and pulled out.

The locking wedge 721 is guided through the bores 724 along two bolts 726 and thus moved perpendicularly to the direction of connection. In order to control the movement a screw 727 is provided which extends through the threaded bore 725. In order to join two platform modules together they are first of all aligned flush with one another, the connecting bolt being in the retracted position and the locking wedge 721 being in a lower position.

In this position, with the platform modules 1 aligned flush, the openings 63 in the longitudinal or transverse side walls 61, 62, the through-bore 722 of the locking wedge 721 and the plug-side end 713 of the connecting bolt 711 are aligned with one another. If the connecting bolt 711 is now pulled out, the plug-side end 713 passes through the openings 10 in the longitudinal or transverse side walls 61, 62 and through the through-bore 722 in the locking wedge 721 until the central part 714 of the connecting bolt 711 is located in the region of the through-bore 722.

By turning the screw 727 the locking wedge 721 is moved along so that the slot 723 of the locking wedge 721 is guided along the disk-shaped lower part 714. The inclined cheek surface 717 of the connecting bolt 711 and the wedge shape of the locking wedge 721 cause the connecting means 71 and 72 on the coupling side and plug side, respectively, to be braced in interlocking engagement and frictionally as the locking wedge 721 is moved along and in this way the platform modules 1 are joined together.

FIG. 9 is a sectional view of a support device 8 of the platform module 1 according to the invention. The supporting device 7 is constructed as a spindle construction which is adjustable in height. A threaded bushing 82 is mounted in the lower opening 24 in a steel bearer 21, 22 in such a way as to extend substantially inside the steel bearer. The threaded bushing 82 and steel bearer 21, 22 are firmly joined together by welding.

A spindle 81 is guided within the threaded bushing 82. The length of the spindle 81 is such that it can be retracted fully into the platform module 1. Vertical adjustment of the spindle 81 is carried out from the top of the platform module 1. For this purpose, openings 23 are provided in the top of the steel bearer 21, 22 and surface elements 5, through which an upper end of the spindle 81 is accessible. If necessary, for example when the ground is very uneven, the spindles 81 can easily be replaced by spindles with a longer adjustment length.

In use, i.e. once the platform is erected, the supporting load of the spindle 81 is distributed to the ground underneath through a load distribution plate 84. The load distribution plate 84 is secured to the platform module 1 during transportation by fixing means (not shown).

In the region of the support device, fixing elements 85 are provided on the steel bearers 21, 22 above the spindles 81. Equipment belonging to the organisations in question can be securely anchored to these fixing elements 85. The fixing elements 85 may, in one simple embodiment, be nuts of suitable dimensions which can be screwed on to the spindle 81. Other methods of attachment may be provided using adaptor plates which can be mounted on the fixing elements 85. Any unused fixing elements 85 or support spindles 82 are covered by a cover plate 86.

Forces may also be transmitted directly to the spindles 81 through the fixing elements 85. In this way, higher loads can be carried in the region of the support devices 8 as these loads are not transmitted to the ladder-type frame 2. This makes it possible to use the modules 1 as tiered staging, i.e. platforms with a number of storeys.

On its upper side the fixing element 85 has a depression 86 in which a region 83 of the threaded bushing 82 projecting from the underside of the steel bearer engages when the modules 1 are stacked. This ensures that the platform modules 1 can be stacked in a safe and stable manner.

FIG. 10 shows a container 100 constructed using the modules 1 according to the invention. It will be apparent that the modules are aligned with their longitudinal and transverse sides adjacent to one another and are fixed together by means of the connecting means 7. The modules 1 are constructed so that the surface elements 5 comprise attachment points 51, at the points of intersection 9 and end points of the ladder-type frame 2, at which the connecting means 7 are provided. Accordingly, the side elements 6 of the modules 1 have openings 63 through which the connecting members 7 can project, The attachment points 51 are designed so that the modules can be coupled to one another in every spatial direction. At the same time the attachment points 51 also allow the assembled components to be adjusted. Moreover, the attachment points 51 may also be used for securing the modules 1 for transportation.

The figures also show supplementary elements, namely glass walls 110. Supplementary elements assist the modules 1 according to the invention in their task of erecting three dimensional structures which can be built to the desired size in every spatial direction. The modules are constructed so that their substructure has a sufficient load-bearing capacity to bear the loads in every spatial direction. The functional suitability of the modules 1 is provided by their adequate rigidity in every spatial direction. The modules 1 are designed so that in spite of being light enough to enable them to be assembled quickly and cheaply, their intrinsic weight provides a sufficient guarantee against their being lifted by the force of the wind in the open air. In the case of modules 1 which are intended as a flooring surface, bags of water may be placed in the cavities of the ladder-type frame 2 to increase the weight and thus provide additional safety.

FIG. 11 shows another possible use of the module according to the invention. The construction shown comprises eight modules 1 and two support beams 120 as supplementary elements which provide additional support for the two modules 1 used as roofing.

FIG. 12 shows a complex use of the module 1 according to the invention. In the modules 1 which form the base surface the attachment points 51 are clearly shown, which enable the modules 1 to be joined together in every spatial direction. The openings 63 are provided accordingly as attachment points in the side faces 6.

The three-storey structure shown in the figure comprises a plurality of supplementary elements. Thus, a plurality of support beams 120 are shown which make it possible to build several storeys in this embodiment. In addition, two ramps 124 are provided, which could also be made up of modules 1 according to the invention. The ramps 124 make it possible to move from one storey to the next. Handrails 126 are provided on the ramps 124 for safety reasons.

FIG. 13 shows details of four module elements 1 with an associated support device 8 in plan view. The support device 8 is arranged in the region of the point 130 where the four module elements 1 meet. The support device acts on the covering elements 5 of the module elements 1.

As the figures show, the platform modules 1 may be put together as horizontal and also vertical surfaces. The modules are particularly suitable for use in the open air or in exhibition halls so as to provide a platform or a stable floor with means of attachment for superstructures.

Individual modules may also be specially adapted for specific tasks and fitted with suitable equipment. For example, modules may be provided which are designed for the attachment of audio, video or other equipment (lighting units and the like) and which comprise suitable connecting elements or even the equipment itself. In order to construct platforms of all kinds, the modules may also have different shapes such as swung side edges and the like.

With the platform module according to the invention it is possible to erect and dismantle flooring or substructures of any desired size within a short time with minimal technical expertise. The platform module permits flexible construction of the flooring or presentation area which is to be erected, while ensuring a high load-bearing capacity and easy and effective levelling of the platform surface.

The invention claimed is:

1. A module assembly for constructing platforms, stages, walls or flooring, comprising a) at least first and second modules, each of said at least first and second modules comprising a frame having a plurality of longitudinal and transverse bearers, each of said bearers having respective end portions, said longitudinal and transverse bearers are connected at points of intersection and said end portions extend beyond said points of intersection;

b) support devices to support said at least first and second modules above the ground, said support devices are retractable into respective said at least first and second modules;

c) each of said at least first and second modules including plug and coupling connectors, each of said plug connectors comprising a plug bolt member and each of said coupling connectors comprising a coupling wedge member wherein said plug bolt member in one of said at least first and second modules is adapted to be received in said coupling wedge member of the other of said at least first and second modules to interlock said at least first and second modules and form a module assembly; and d) each of said end portions including said plug bolt member or said wedge member, said plug bolt member is movable into and out of said end portions whereby, said each of said plug bolt and the said wedge member are coaxially aligned with the longitudinal axis of each of said end portions of each respective longitudinal and transverse bearers.

2. The module assembly according to claim 1, wherein the frame is provided with side faces.

3. The module assembly according to claim 2, wherein openings are provided in the side faces for the connectors.

4. The module assembly according to claim 1, wherein covering elements forming a module surface are provided on an upper surface of the module.

5. The module assembly according to claim 4, wherein the covering elements are constructed as perforated caissons of U-shaped cross section.

6. The module assembly according to claim 4 and wherein each of said at least first and second modules is provided with side walls having shoulder portions so that when said at least first modules is caused to be interlocked to said at least second module, a channel is formed by said respective shoulder portions abutting against each other and further comprising a channel covering element having a U-shaped profile for covering said channel formed by said respective shoulder portions.

7. The module assembly according to claim 1, wherein the longitudinal and transverse bearers are aligned perpendicular to one another.

8. The module assembly according to claim 1, wherein the support devices are individually adjustable in height.

9. The module assembly according to claim 1, wherein the support devices are arranged on the frame.

10. The module assembly according to claim 9, wherein the support devices are mounted at points of intersection of the longitudinal and transverse bearers.

11. The module assembly according to claim 1, wherein the coupling connectors are constructed as a locking wedge and the plug connectors are constructed as movably mounted connecting bolts.

12. The module assembly according to claim 1, wherein the connectors are arranged substantially in the longitudinal direction of the longitudinal and transverse bearers.

13. The module assembly according to claim 1, wherein the connectors are provided at points of intersection of the longitudinal and transverse bearers.

14. The module assembly according to claim 1, wherein the connectors are provided at the ends of the longitudinal and transverse bearers.

15. The module assembly according to claim 1, and further comprising a number of the modules joined together to form a platform having means for attachment of superstructures.

* * * * *

UNITED STATES PATENT AND TRADEMARK OFFICE

CERTIFICATE OF CORRECTION

PATENT NO. : 7,398,626 B2
APPLICATION NO. : 10/312595
DATED : July 15, 2008
INVENTOR(S) : Hubertus Greschbach It is certified that error appears in the above-identified patent and that said Letters Patent is hereby corrected as shown below:

Column 1, after the title of the invention insert --Background of the Invention-- as a new line; next line insert --Field of the Invention-- as a new line; after line 18 insert --Description of the Related Art-- as a new line; after line 39 insert --Summary of the Invention-- as a new line;

Column 3, after line 5 insert --Brief Description of the Drawings-- as a new line; after line 32 insert --Detailed Description of the Preferred Embodiments-- as a new line.

Signed and Sealed this

Eleventh Day of August, 2009

David J. Kappos

David J. Kappos
*Director of the United States Patent and Trademark Office*